United States Patent [19]

Rahman

[11] 4,278,617

[45] Jul. 14, 1981

[54] HUMIDIFIER

[75] Inventor: Michael Rahman, Winston-Salem, N.C.

[73] Assignee: Envirotech Corporation, Menlo Park, Calif.

[21] Appl. No.: 126,786

[22] Filed: Mar. 3, 1980 (Under 37 CFR 1.47)

[51] Int. Cl.[3] ..... B01F 3/04

[52] U.S. Cl. ..... 261/30; 261/90; 261/118; 261/DIG. 15

[58] Field of Search ..... 261/30, 90, DIG. 15, 261/88, 89, 118

[56] References Cited

U.S. PATENT DOCUMENTS

| | | | |
|---|---|---|---|
| 1,524,777 | 2/1925 | Braemer | 261/90 |
| 2,163,474 | 6/1939 | Sloan | 261/30 |
| 3,802,162 | 4/1974 | Deane | 261/90 X |
| 3,804,383 | 4/1974 | Van Diepenbroek | 261/90 X |
| 4,174,362 | 11/1979 | Rahman | 261/DIG. 15 |

FOREIGN PATENT DOCUMENTS

| | | | |
|---|---|---|---|
| 578671 | 8/1930 | Fed. Rep. of Germany | 261/90 |
| 1352885 | 1/1964 | France | 261/90 |

*Primary Examiner*—Richard L. Chiesa
*Attorney, Agent, or Firm*—Robert E. Krebs; T. J. McNaughton

[57] ABSTRACT

A humidifier comprises a conduit (20), a rotatable fan assembly (30) mounted in the conduit (20) for causing an air stream to flow through the conduit (20), and a counter-rotatable water slinger assembly (40) mounted coaxially with and downstream of the fan assembly (30) for centrifugally ejecting water into the conduit (20). A cylindrical mist-forming member (60) affixed to the fan assembly (30) for rotation therewith extends downstream therefrom so as to surround the water slinger assembly (40). Water ejected centrifugally from the water slinger assembly (40) is sheared by the mist-forming member (60) into a mist of fine water droplets, which become entrained in the air stream passing through the conduit (20).

1 Claim, 7 Drawing Figures

HUMIDIFIER

BACKGROUND OF THE INVENTION

1. Field of the Invention

This invention relates to humidification apparatus.

2. State of the Prior Art

In a typical humidifier, a fan draws a stream of air through a mist of fine water droplets, so that the water droplets can become entrained in the air stream. With certain kinds of humidifiers, the droplet-laden air stream is discharged directly into a room or working space. An example of such a space humidifier is described in U.S. Pat. No. 2,163,474. With other kinds of humidifiers, the droplet-laden air stream is conducted via a duct system to an area where the atmosphere is to be humidified. An example of such a humidifier designed for use with a duct system is described in U.S. Pat. No. 4,174,362.

In the humidifier described in U.S. Pat. No. 4,174,362, a mist of fine water droplets is formed adjacent the periphery of a disc-shaped centrifugal water slinger, and a stream of air is drawn through the mist by a fan located downstream of the water slinger. The water droplets entrained in the air stream pass through the rotating blades of the fan in travelling to the atmosphere to be humidified.

It has been found that when water droplets entrained in an air stream come into contact with the rotating blades of a fan, the droplets tend to agglomerate into larger-size drops of water that are too large for efficient transportation by the air stream through downstream ducting. Also, high-speed impact of entrained water droplets on the fan blades tends to cause erosion and/or corrosion of the surfaces of the fan blades.

In humidifiers of the prior art, the bearings that enabled rotation of the fans and water slingers were typically exposed to the humidifying mist, so that significant accumulation of moisture in the bearings was generally unavoidable. Such moisture tended to limit the useful lifetime of the bearings. Furthermore, centrifuging of the grease in the bearings further limited the useful lifetime of the bearings in prior art humidifiers.

OBJECT OF THE INVENTION

It is an object of the present invention to provide a humidifier in which a fan for drawing air through a mist of fine water droplets is located upstream of where the mist is formed, thereby preventing high-speed impact of water droplets on the blades of the fan.

A feature of the present invention is that the fan for drawing air through the mist is located upstream of a disc-shaped centrifugal water slinger. The mist is formed around the periphery of the water slinger, and the fan directs a stream of air through the mist in order to entrain fine water droplets in the air stream.

With a humidifier according to the present invention, entrainment of the water droplets in the air stream occurs downstream of the fan. In that way, the fan blades are protected from high-speed impact by the water droplets, and the bearings of the fan are isolated from the droplet-laden air stream.

DESCRIPTION OF PREFERRED EMBODIMENT

Figure 1A:
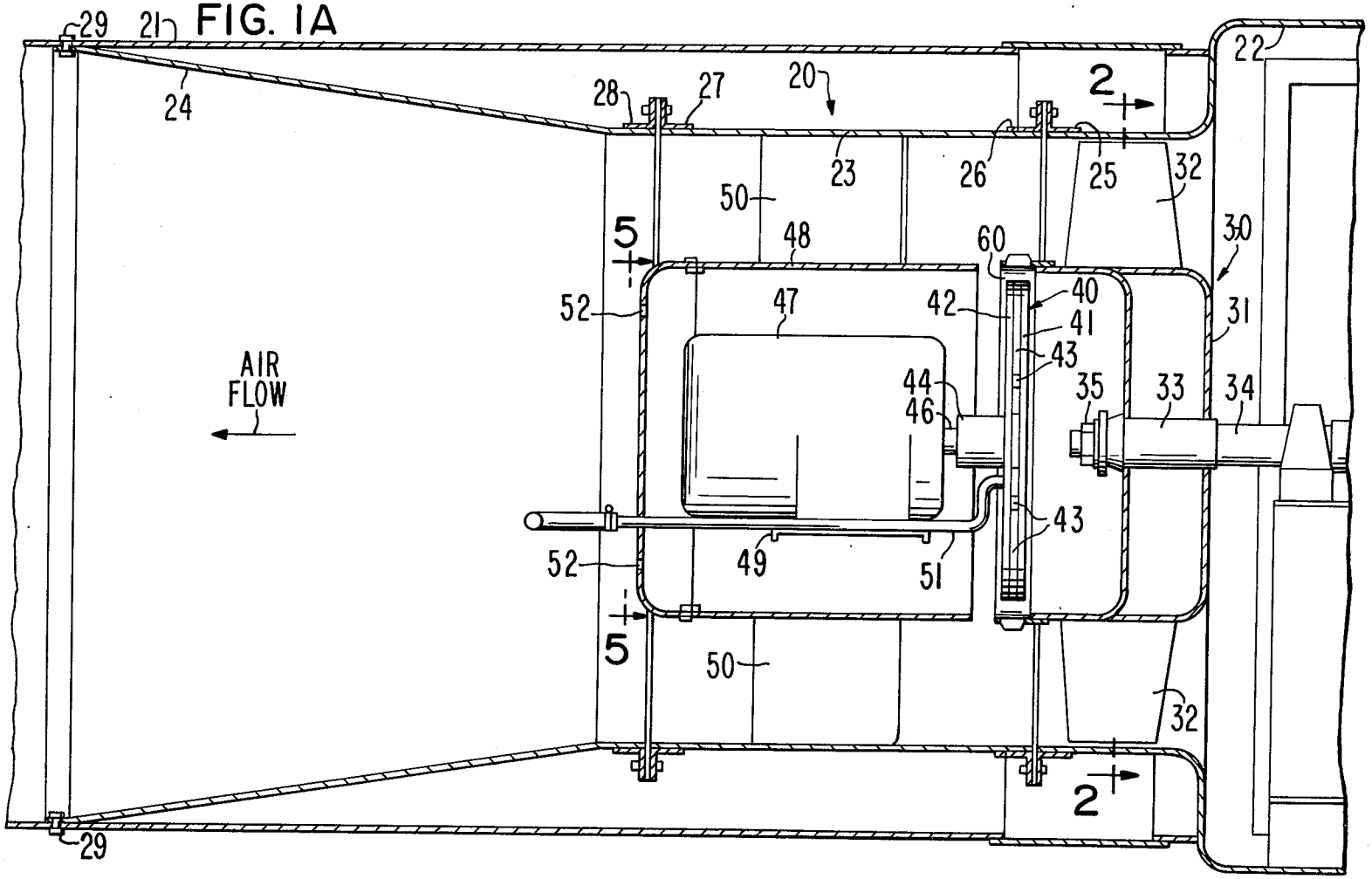
FIG. 1A is an elevational view, partially in cross section, of a humidifier according to the present invention.
Figure 1B:
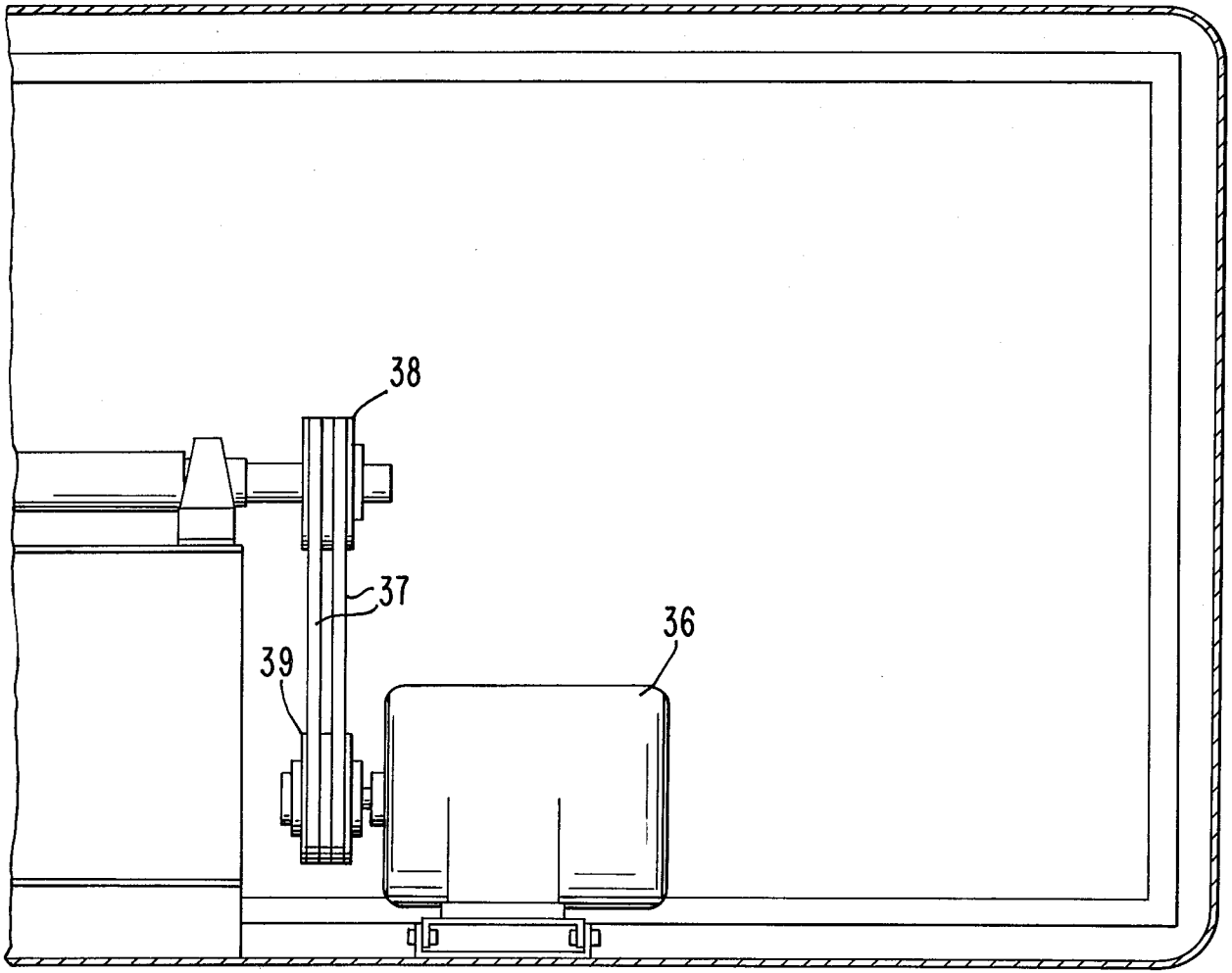
FIG. 1B, likewise an elevational view, is a continuation of FIG. 1A.

A humidifier according to the present invention, as shown in FIGS. 1A and 1B, comprises a generally tubular conduit 20 in which a mist of fine water droplets is produced. An air stream is drawn through the mist in the direction indicated by the arrow, so that water droplets can become entrained in the air stream. The droplet-laden air stream then flows into a distribution duct 21 to which the conduit 20 is coupled. The distribution duct 21 shown in FIG. 1A represents conventional means for distributing the droplet-laden air to an area or areas where the atmosphere is to be humidified.

Humidifiers according to the present invention are especially suited for installation in industrial plants requiring precisely controlled humidification of atmospheres in work areas or storage areas. In particular, the present invention is contemplated for use in textile manufacturing plants, wood products plants, and paper converting and printing plants. The distribution duct 21 might represent, for example, a duct leading to a network of air conditioning plenums, so that a humidifier according to the present invention could readily be installed as a retrofit to an existing industrial atmospheric control system.

The conduit 20 comprises an air intake segment 22, a mist-forming segment 23 located downstream of the air intake segment 22, and a humidified air discharge segment 24 located downstream of the mist-forming segment 23. The precise configuration of the duct 20 is not critical to the present invention, although in the preferred embodiment the conduit segments 22, 23 and 24 are generally symmetric about a common axis running longitudinally through the duct 20. The segments 22, 23 and 24 could be portions of an integral conduit structure, but are preferably separate structures joined in such a way as to provide a smooth and continuous flow path for an air stream passing therethrough.

In the embodiment shown in FIG. 1A, flanged rings 25 and 26 are affixed by conventional means (as by brazing) to corresponding mating ends of the conduit segments 22 and 23, respectively; and the opposing flanged portions of the rings 25 and 26 are bolted together, with a suitable gasket ring interposed therebetween, to join the segments 22 and 23. Similarly, flanged rings 27 and 28 are affixed to corresponding mating ends of the conduit segments 23 and 24, respectively; and the opposing flanged portions of the rings 27 and 28 are bolted together, with a suitable gasket ring interposed therebetween, to join the segments 27 and 28. The downstream end of the conduit 20 is inserted into the distribution duct 21, and is secured thereto by conventional means such as by rivets or machine screws 29.

A fan assembly 30 is mounted at the downstream end of the air intake segment 22 to move an air stream into and through the conduit 20. The upstream end of the air intake segment 22 may be of relatively wide cross section in order to maximize the volume of air drawn toward the fan assembly 30. The actual configuration and dimensions of the air intake segment 22 would ordinarily be determined by the requirements, according to the particular application, for dampers and other accessories. The downstream end of the air intake assembly 22 is preferably of relatively narrow cross section. As shown in FIG. 1A, the downstream end of the air intake assembly 22 is just large enough to accommodate radially projecting fan blades 32 of the fan assembly 30.

The fan assembly 30 comprises a hub 31 to which several (e.g., four) fan blades 32 are attached. The hub 31 is mounted within the air intake segment 22 for rotary motion about the longitudinal axis of the conduit 20. Although the precise structural details of the hub 31 are not critical to the present invention, the hub 31 is preferably of generally cylindrical configuration. As shown in FIG. 1A, the hub 31 may conveniently be fabricated from two aligned cup-shaped members welded together to form a cylindrical structure having a double-walled upstream end and an open downstream end. The cylinrical wall of the hub 31 supports the fan blades 32, which are arranged symmetrically around the outer surface thereof. Aligned central apertures are provided in each of the two walls comprising the upstream end of the hub 31 in order to accommodate a sleeve 33, which passes therethrough and lies along the axis of the conduit 20. The sleeve 33 is fastened (as by brazing) to both upstream end walls, which together provide a rigid support for the sleeve 33.

A rotary shaft 34 extends through and is demountably secured to the sleeve 33 to enable rotation of the fan hub 31. As shown in FIGS. 1A and 1B, the shaft 34 extends through the sleeve 33 to the downstream side of the double-walled end of the hub 31, and is fastened to the hub 31 by a nut 35. The shaft 34 could be the shaft, or an extension on the shaft, of an electric motor disposed coaxially with the axis of the fan hub 31 along the longitudinal axis of the conduit 20. In the embodiment shown in FIG. 1B, however, the shaft 34 is rotated by a motor 36 located away from the axis of the conduit 20; and power is supplied from the motor 36 to the shaft 34 by an endless belt 37 connecting a sheave 38 on the shaft 34 with a sheave 39 on the shaft of the motor 36. The shaft 34 may be supported within the air intake segment 22 by conventional means, such as bearings mounted on a horizontal support plate.

Figure 2:
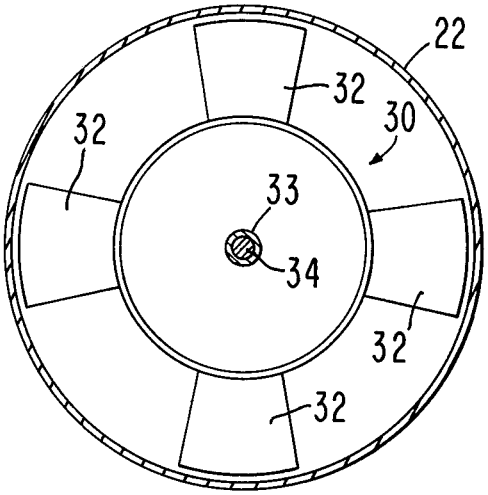
FIG. 2 is a cross-sectional end view, reduced in size, of the fan assembly along line 2—2 of FIG. 1A.

A cross-sectional end view of the fan assembly 30 looking in the upstream direction is provided in FIG. 2. Four blades 32 are shown affixed to the cylindrical wall of the fan hub 31, although the number of fan blades 32 is not critical to the invention. Each blade 32 is configured to move air into and through the conduit 20 in a direction from the air intake segment 22 to the humidified air discharge segment 24 as the fan assembly 30 is rotated.

Figure 3:
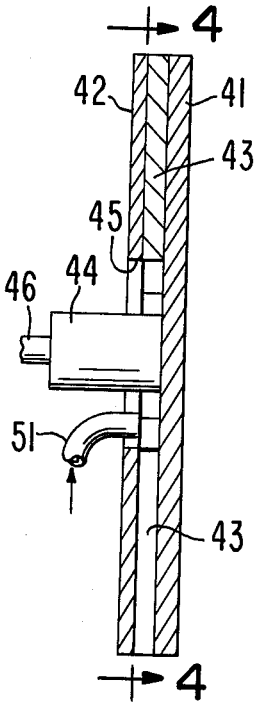
FIG. 3 is an elevational view, enlarged in size and partially in cross section, showing the centrifugal water slinger assembly of FIG. 1A.

With reference again to FIG. 1A, a water slinger assembly 40 is mounted in the mist-forming segment 23 of the conduit 20 downstream of the fan assembly 30. As shown in greater detail in FIGS. 3 and 4, the water slinger assembly 40 of the preferred embodiment of this invention comprises a pair of parallel plates 41 and 42 of circular perimeter mounted for rotary motion about the longitudinal axis of the conduit 20, i.e., coaxially with respect to the fan assembly 30. The upstream plate 41 is shaped as a solid disc, with several (e.g., six) radially extending vanes 43 and a central hub 44 affixed thereto (as by brazing) and projecting from the downstream-facing surface thereof. The downstream plate 42 abuts the downstream ends of the vanes 43, and has a central aperture 45 for receiving the central hub 44 therethrough.

Figure 4:
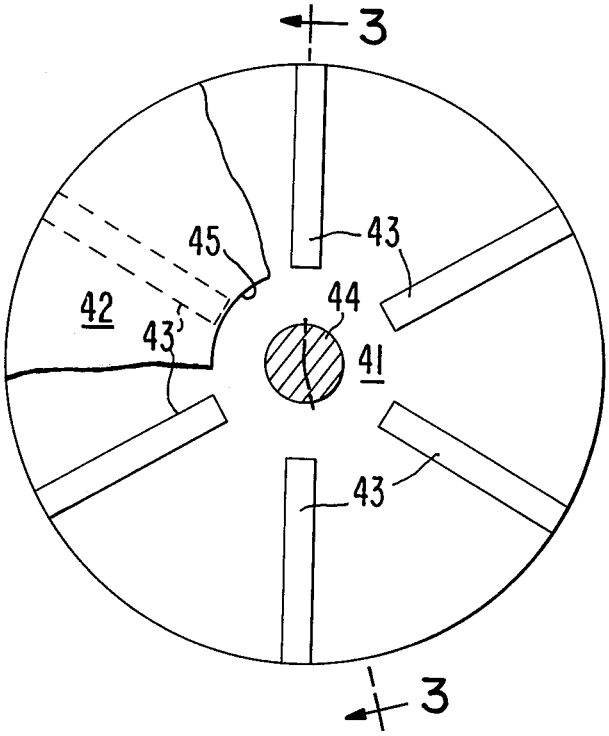
FIG. 4 is a cross-sectional end view, partially cut away, of the water slinger assembly along line 4—4 of FIG. 3.

As shown in FIG. 4, the vanes 43 extend radially with respect to the axis of the water slinger assembly 40, and have an outer radius equal to the outer radius of the plates 41 and 42 and an inner radius equal to the radius of the central aperture 45 in the plate 42. The plate 42 is secured by conventional means (as by brazing) the vanes 43 in order to enable rotation of the plates 41 and 42 and the vanes 43 as a unit. The vanes 43 are arranged, preferably symmetrically, to define sector-shaped water receiving channels in the region between the parallel plates 41 and 42. In the preferred embodiment, the water receiving channels are of substantially equal size.

Again referring to FIG. 1A, the central hub 44 is coaxially attached to a rotary shaft 46 of an electric motor 47. The motor 47 is encased within a housing structure 48, which is of generally cylindrical configuration and mounted coaxially with respect to the axis of the conduit 20. The motor 47 is secured (as by bolting) to a horizontal support plate 49, opposite ends of which are secured (as by bolting) to the cylindrical inner wall of the housing structure 48. Several (e.g., four) air straightening vanes 50 are provided extending radially outward from the outer cylindrical wall of the housing structure 48 to the inner cylindrical wall of the mist-forming segment 23 of the conduit 20. The air straightening vanes 50 serve to diminish the spiral motion of the air coming from the fan blades 32, and also to support the housing structure 48 within the conduit 20. The number of air straightening vanes 50 provided depends upon the size of the humidifier. As the size of the humidifier (and correspondingly the mass flow rate of air moved by the fan blades 32) increases, the number of air straightening vanes 50 should likewise increase.

A water feed means 51 is provided to deliver water at a predetermined rate into each of the water-receiving channels of the water slinger assembly 40 in succession as the water slinger assembly 40 rotates. As indicated in FIG. 1A, the water feed means 51 comprises a pipe leading from a water source located outside the conduit 20 to the region between the two plates 41 and 42 of the water slinger assembly 40. The water feed means 51 passes through appropriately located apertures in the walls of the conduit 20 and the motor housing structure 48, and extends through the central aperture 45 in the plate 42 into the region between the plates 41 and 42. As the water slinger assembly 40 rotates, each water-receiving channel between adjacent vanes 43 in succession comes into position to receive the outflow from the water feed means 51. The water supplied to the water-receiving channels moves radially outward in the channels by centrifugal force toward the periphery of the rotating water slinger assembly 40, and is then ejected (or "slung") therefrom into the mist-forming segment 23 of the conduit 20.

Figure 5:
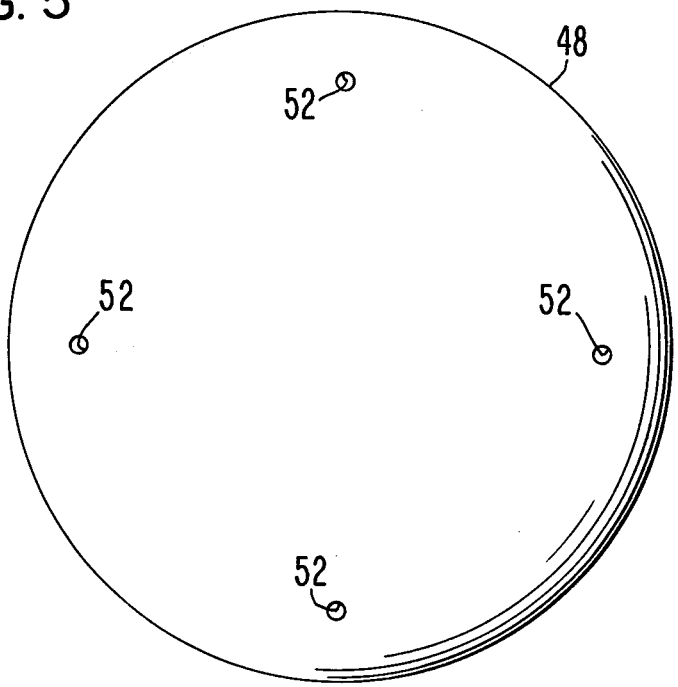
FIG. 5 is an end elevational view of the motor housing structure of FIG. 1A.

The motor housing structure 48 is open at its upstream end adjacent the water slinger assembly 40, and is closed at its downstream end. Preferably, apertures 52 are provided in the closed downstream end of the housing structure 48 as shown in FIG. 5, so that an air flow can be induced through the housing structure 48 by the rotation of the water slinger assembly 40. The outside cross-sectional diameter of the housing structure 48 is substantially the same as the outside cross-sectional diameter of the fan hub 31 in order to provide an aerodynamically continuous flow path outside the housing structure 48 for the droplet-laden air that is moved through the conduit 20 by the rotating fan blades 32. In this way, ventilating of the motor 47 with non-moist air can be provided while protecting the motor 47 and its associated bearings from the moisture contained in the droplet-laden air flow caused by the rotating fan blades 32.

Figure 6:
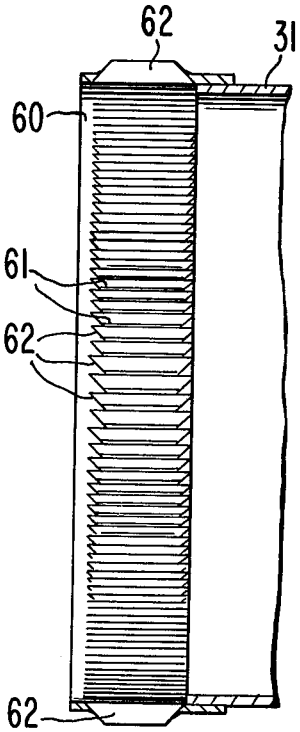
FIG. 6 is an elevational view, enlarged in size, of the mist-forming member of FIG. 1A.

Again referring to FIG. 1A, a generally cylindrical mist-forming member 60 is attached to the downstream end of the fan hub 31 projecting coaxially downstream therefrom into the mist-forming segment 23 of the conduit 20. As shown in enlarged view in FIG. 6, evenly spaced slots 61 are provided around the cylindrical surface of the mist-forming member 61, with a fin 62 extending radially outward beside each slot 61. The mist-forming member 60 may conveniently be fabricated from a strip of metal by making non-linear cuts at evenly spaced intervals generally transverse to the elongate dimension of the strip, and then bending tab-like portions of the cut metal in the same direction away from the surface of the strip. The strip is then formed into a cylindrical band to make the mist-forming member 60. The openings left in the strip of metal by the bending of the tab-like portions away from the surface of the strip constitute the slots 61, and the tab-like portions constitute the radially extending fins 62. The mist-forming member 60 is fitted over the downstream edge of the fan hub 31, and is attached thereto by conventional means such as by screws.

The cylindrical mist-forming member 60 projects far enough into the mist-forming segment 23 to surround the water slinger assembly 40. The direction of rotation of the fan hub 31, and therefore of the attached mist-forming member 60, is opposite to the direction of rotation of the water slinger assembly 40. The water ejected centrifugally from each of the water-receiving channels of the rotating slinger assembly 40 passes through the slots 61 of the mist-forming member 60 and interacts with the counter-rotating fins 62. The water impinging upon the fins 62 is effectively sheared or "chopped" into droplets of extremely small size, and the mist thereby created in the mist-forming segment 23 is entrained by the air stream drawn into the conduit 20 by the rotating fan blades 32. The air stream with its entrained mist then passes via the humidified air discharge segment 24 of the conduit 20 into the duct 21 for distribution to a work area or other place where a humidified atmosphere is to be maintained.

As mentioned above, the segments 22, 23 and 24 of the conduit 20 could be portions of an integral conduit structure. However, if the segments 22, 23 and 24 are separate structural members as in the preferred embodiment of the invention, access to the motor 47 and water slinger assembly 40 in the mist-forming segment 23 and to the fan assembly 30 in the air intake segment 22 is facilitated. Because the fan assembly 30 is located upstream of the mist-forming member 60, high-speed impact of water droplets upon the fan blades 32 is precluded. The air stream drawn into the conduit 20 carries the fine water droplets of the mist downstream away from the fan assembly 30, thereby preventing accumulation of moisture in the bearings that enable rotation of the fan hub 31.

Since the diameter of the motor housing structure 48 is substantially the same as the diameter of the fan hub 31, the housing structure 48 functions as an aerodynamic extension of the fan hub 31. Air directed by the fan blades 32 through the region adjacent the periphery of the mist-forming member 60 is therefore swept through the annular region between the inner wall of the mist-forming segment 23 and the outer wall of the motor housing structure 48 to the humidified air discharge segment 24. The motor 47 lies away from the flow path of the droplet-laden air stream, and the bearings of the motor 47 are thereby protected from moisture accumulation. Furthermore, the induction of non-moist air through the interior of the motor housing structure 48 due to the rotation of the slinger assembly 40 provides ventilation for the motor 47.

Since the motor 47 directly rotates the central hub 44 attached to the plate 41 of the water slinger assembly 40, the motor 47 can be relatively small needing to draw only enough power to turn the water slinger assembly 40. By way of contrast, if the motor for driving the water slinger assembly 40 were located away from the axis of rotation of the central hub 44, a larger motor with correspondingly larger bearings would be needed to drive a belt mechanism for transmitting power to the water slinger assembly 40. With the present invention, therefore, economies in motor size and electric power consumption can be achieved. Furthermore, with the present invention, the size and the lubrication requirements of internal bearings of the motor 47 that rotates the water slinger assembly 40 are substantially determined only by the motor specifications, and are not dictated by power requirements of any belt drive mechanism.

This invention has been described above in terms of specific structural details, which are to be considered as illustrative rather than limiting. Various changes and modifications in the design of the preferred embodiment could be made by workers skilled in the art without departing from the fundamental teachings of this invention. The above disclosure, therefore, is to be interpreted as a description of the best mode contemplated by the inventor of carrying out his invention. The scope of the invention is defined by the following claims and their equivalents.

What is claimed is:

1. A humidifier comprising:

(a) a conduit;

(b) a fan assembly mounted in said conduit for rotation about an axis, said fan assembly causing an air stream to flow through said conduit when said fan assembly is rotated;

(c) a water slinger assembly mounted in said conduit downstream of said fan assembly for rotation about said axis, said water slinger assembly including:

(i) a first plate;

(ii) a second plate, said first and second plate being mounted spaced apart from each other for rotation about said axis; and (iii) vanes interposed between said first and second plates to define a plurality of water channels, each water channel being located between two adjacent vanes;

(d) means for introducing water into each of said water channels;

(e) means for rotating said water slinger assembly to cause water to be ejected from said water channels into a region peripherally adjacent said water slinger assembly, said means for rotating said water slinger assembly comprises a motor having a shaft that is coaxial with said axis of rotation, said motor being surrounded by a housing structure to protect said motor from substantial accumulation of moisture, said housing structure being of substantially cylindrical configuration having an open end adjacent said water slinger assembly and a closed end remote from said water slinger assembly, said closed end being downstream of said motor and being apertured to enable a stream of air induced by rotation of said water slinger assembly to pass therethrough to ventilate said motor;

(f) a generally cylindrical mist-forming member affixed to said fan assembly and surrounding said region peripherally adjacent said water slinger assembly; and (g) means for rotating said fan assembly and said attached mist-forming member about said axis in a direction opposite to the direction of rotation of said slinger assembly, said forming member functioning to interact with the water ejected by said water slinger assembly to form a mist of fine water droplets, said fine water droplets becoming entrained in said air stream flowing through said conduit.

* * * * *